United States Patent [19]

Kuhnel et al.

[11] Patent Number: 4,686,428

[45] Date of Patent: Aug. 11, 1987

[54] HIGH INTENSITY DISCHARGE LAMP SELF-ADJUSTING BALLAST SYSTEM WITH CURRENT LIMITERS AND A CURRENT FEEDBACK LOOP

[75] Inventors: Donald S. Kuhnel, Houston; Sidney A. Ottenstein, Spring, both of Tex.

[73] Assignee: Innovative Controls, Incorporated, Houston, Tex.

[21] Appl. No.: 875,724

[22] Filed: Jun. 18, 1986

Related U.S. Application Data

[63] Continuation-in-part of Ser. No. 770,663, Aug. 28, 1985.

[51] Int. Cl.[4] ..... G05F 1/00; H05B 37/02; H05B 39/04; H05B 41/36

[52] U.S. Cl. ..... 315/307; 315/291; 315/309; 315/158; 315/151; 323/277

[58] Field of Search ..... 315/306, 307, 308, 291, 315/309, DIG. 7, 158, 159, 151, 157, 155; 323/265, 277

[56] References Cited

U.S. PATENT DOCUMENTS

| | | | |
|---|---|---|---|
| Re. 29,498 | 12/1977 | Meiattini | 195/103.5 |
| Re. 30,296 | 6/1980 | Kirby | 307/252 |
| 3,222,572 | 12/1965 | Powell | 315/151 |
| 3,247,422 | 4/1966 | Schultz | 315/206 |
| 3,259,797 | 7/1966 | Heine | 315/174 |
| 3,265,930 | 8/1966 | Powell | 315/209 |
| 3,309,567 | 3/1967 | Flieder | 315/176 |
| 3,486,070 | 12/1967 | Engel | 315/225 |
| 3,541,421 | 11/1970 | Buchman | 320/1 |
| 3,582,708 | 6/1971 | Snyder | 315/91 |
| 3,590,316 | 6/1971 | Engel | 315/209 |
| 3,619,713 | 11/1971 | Biega | 315/105 |
| 3,659,146 | 4/1972 | Munson | 315/92 |
| 3,681,654 | 8/1972 | Quinn | 315/151 |
| 3,753,071 | 8/1971 | Engel | 315/2 |
| 3,754,160 | 8/1973 | Jensen | 315/97 |
| 3,870,943 | 3/1975 | Weischedel | 321/2 |
| 3,873,882 | 3/1975 | Gershen | 315/92 |
| 3,876,855 | 4/1975 | Hirasawa | 219/131 |
| 3,882,354 | 5/1975 | May | 315/101 |
| 3,886,045 | 5/1975 | Meiattini | 195/103.5 |
| 3,890,537 | 6/1975 | Park | 315/208 |
| 3,906,302 | 9/1975 | Wigjboom | 315/209 |
| 3,927,348 | 12/1975 | Zawakski | 315/88 |
| 3,927,349 | 12/1975 | Suhren | 315/205 |
| 3,944,876 | 3/1976 | Helmuth | 315/205 |
| 3,967,159 | 6/1976 | Dendy | 315/247 |
| 3,969,652 | 7/1976 | Herzog | 315/224 |
| 3,999,100 | 1/1977 | Dendy | 315/308 |
| 4,004,187 | 1/1977 | Walker | 315/205 |
| 4,004,188 | 1/1977 | Cooper | 315/224 |
| 4,016,451 | 4/1977 | Engel | 315/158 |
| 4,023,067 | 5/1977 | Zelina | 315/209 |
| 4,039,897 | 8/1977 | Dragoset | 315/205 |
| 4,042,856 | 8/1977 | Steigerwald | 315/246 |
| 4,051,413 | 9/1977 | Abadie | 315/219 |
| 4,060,751 | 11/1977 | Anderson | 315/209 |
| 4,060,752 | 11/1977 | Walker | 315/244 |
| 4,066,930 | 1/1978 | Summa | 315/209 |
| 4,074,170 | 2/1978 | Orban | 315/120 |
| 4,087,702 | 5/1978 | Kirby | 307/252 |
| 4,100,462 | 7/1978 | McLellan | 315/179 |
| 4,121,136 | 10/1978 | Fournier | 315/205 |
| 4,127,789 | 11/1978 | Anderson | 315/209 |
| 4,127,795 | 11/1978 | Knoll | 315/210 |
| 4,145,636 | 3/1979 | Doi | 315/101 |
| 4,151,445 | 4/1979 | Davenport | 315/92 |
| 4,156,166 | 5/1979 | Shapiro | 315/209 |
| 4,163,923 | 8/1979 | Herbers | 315/209 |
| 4,170,747 | 10/1979 | Holmes | 315/307 |
| 4,199,710 | 4/1980 | Knoll | 315/307 |
| 4,204,141 | 5/1980 | Nuver | 315/205 |
| 4,210,846 | 7/1980 | Capewell | 315/311 |

(List continued on next page.)

*Primary Examiner*—Saxfield Chatmon
*Attorney, Agent, or Firm*—Vaden, Eickenroht, Thompson & Boulware

[57] ABSTRACT

The invention comprises a self-adjusting ballast system for a high intensity discharge lamp. The ballast has a current limiter which modifies the lamp's present duty cycle to prevent damage if bulb rectification or another overcurrent condition occurs. It also has a current integration feedback loop for controlling lamp current during start-up.

6 Claims, 4 Drawing Figures

U.S. PATENT DOCUMENTS

| | | | |
|---|---|---|---|
| 4,219,760 | 8/1980 | Ferro | 315/121 |
| 4,232,252 | 11/1980 | Peil | 315/248 |
| 4,234,823 | 11/1980 | Charlot | 315/92 |
| 4,236,100 | 11/1980 | Nuver | 315/224 |
| 4,236,101 | 11/1980 | Luchaco | 315/158 |
| 4,237,403 | 12/1980 | Davis | 315/98 |
| 4,238,710 | 12/1980 | Nelson | 315/307 |
| 4,240,009 | 12/1980 | Paul | 315/224 |
| 4,241,295 | 12/1980 | Williams | 315/294 |
| 4,245,177 | 1/1981 | Schmitz | 315/205 |
| 4,251,752 | 2/1981 | Stolz | 315/206 |
| 4,253,046 | 2/1981 | Gerhard | 315/224 |
| 4,259,614 | 3/1981 | Kohler | 315/219 |
| 4,277,728 | 7/1981 | Stevens | 315/307 |
| 4,286,195 | 8/1981 | Swines | 315/224 |
| 4,287,468 | 9/1981 | Sherman | 315/322 |
| 4,316,127 | 2/1982 | Lamoureux | 315/408 |
| 4,322,817 | 3/1982 | Kuster | 363/26 |
| 4,323,824 | 4/1982 | Roche | 315/289 |
| 4,346,331 | 8/1982 | Hoge | 315/158 |
| 4,348,615 | 9/1982 | Garrison et al. | 315/219 |
| 4,350,930 | 9/1982 | Peil et al. | 315/49 |
| 4,358,716 | 11/1982 | Cordes et al. | 315/306 |
| 4,370,601 | 1/1983 | Horii et al. | 315/307 |
| 4,378,513 | 3/1983 | Yoshikawa et al. | 315/176 |
| 4,388,562 | 6/1983 | Josephson | 315/205 |
| 4,412,154 | 10/1983 | Klein | 315/224 |
| 4,415,839 | 11/1983 | Lesea | 315/209 R |
| 4,415,839 | 11/1983 | Lesea | 315/308 |
| 4,437,043 | 3/1984 | Pitel | 315/808 |
| 4,464,606 | 8/1984 | Kane | 315/224 |
| 4,498,031 | 2/1985 | Stupp | 315/307 |
| 4,511,195 | 4/1985 | Barter | 315/308 |
| 4,585,974 | 4/1986 | Stupp et al. | 315/307 |

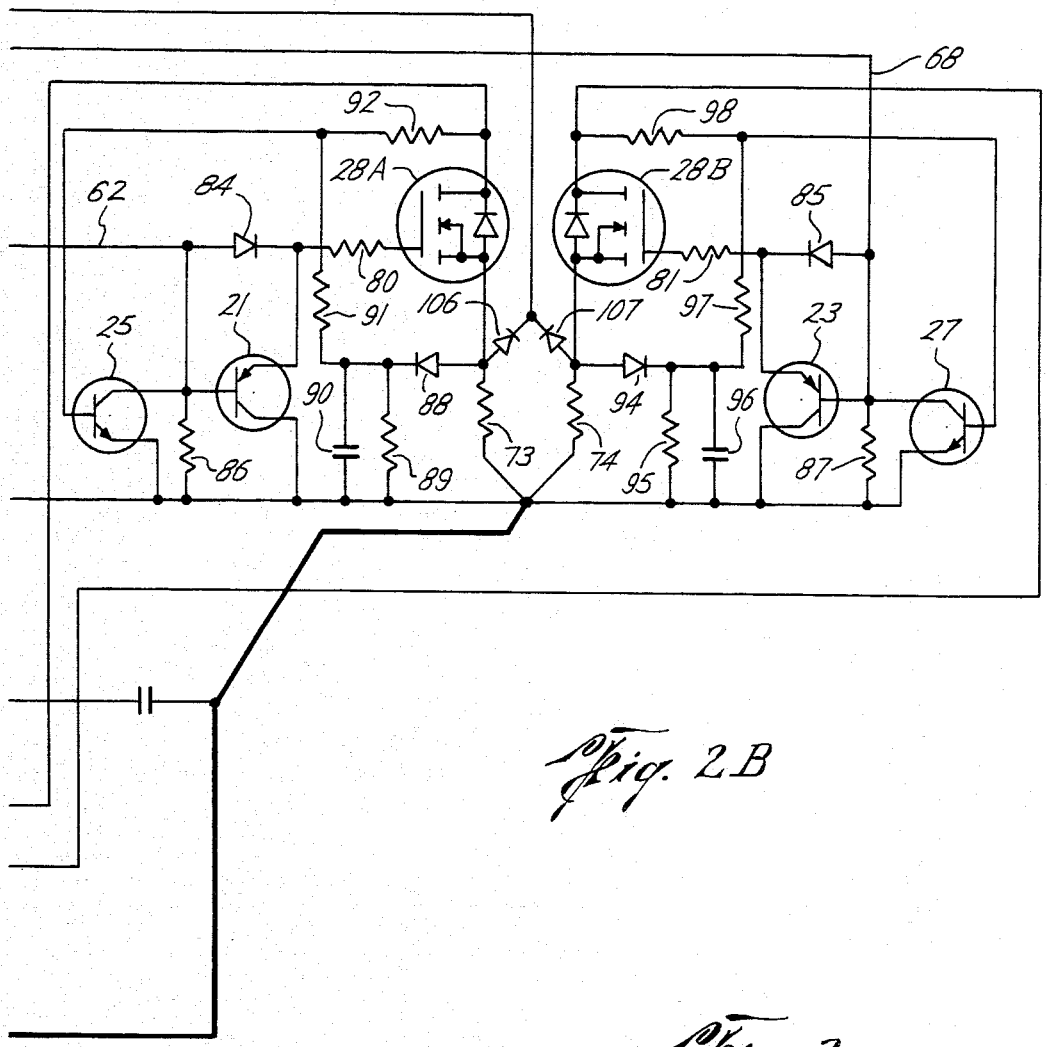
Fig. 2B
Fig. 3
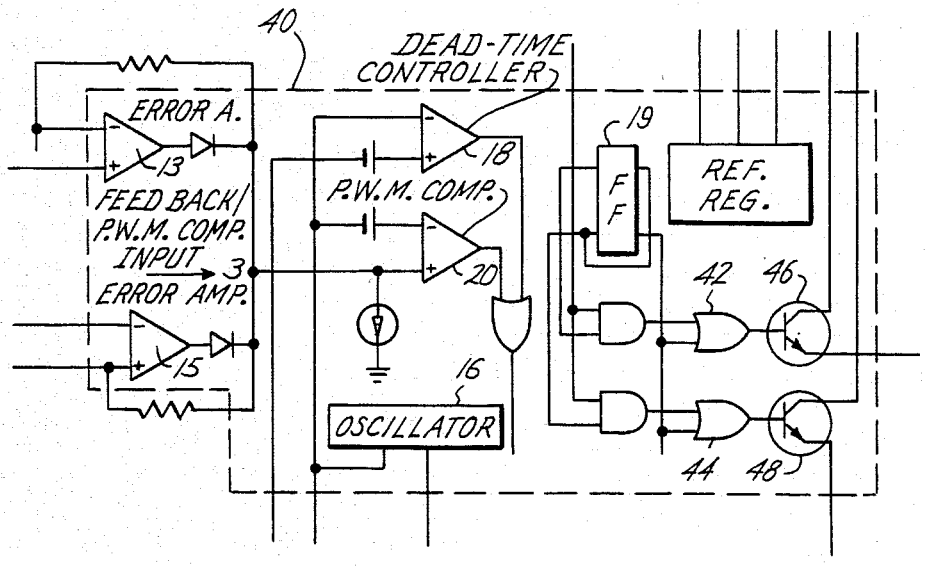

HIGH INTENSITY DISCHARGE LAMP SELF-ADJUSTING BALLAST SYSTEM WITH CURRENT LIMITERS AND A CURRENT FEEDBACK LOOP

This application is a continuation-in-part of co-pending U.S. Ser. No. 770,663, filed Aug. 28, 1985, which is incorporated by reference herein.

FIELD OF INVENTION

This invention relates to the field of electronic solid state ballast systems for high intensity discharge lamps. More particularly, this invention relates to the field of controlled systems for ballasting high intensity discharge lamps that efficiently and economically maintain an appropriate power level for the lamp during striking, warm-up and normal running.

BACKGROUND OF THE INVENTION

In high intensity discharge lamps, light is generated when an electric current is passed through a gaseous medium. The lamps have variable resistance characteristics that require operation in conjunction with a ballast to provide appropriate voltage and current limiting means. Control of the voltage, frequency and current supplied to the lamp is necessary for proper operation and determines the efficiency of the lamp. In particular, it determines the size and weight of the required ballast.

The appropriate voltage, frequency and current for efficient running of a lamp in its normal operating stage is not appropriate for the lamp during its warm-up stage. A high intensity discharge lamp typically takes several minutes to warm-up from the time it is struck or turned on to its normal operating state. Initially the lamp is an open circuit. Short pulses of current are sufficient to strike the lamp provided they are of adequate voltage. Subsequent to striking, the lamp's resistance drops radically. The resistance then slowly rises during warm-up to its normal operating level. Hence, subsequent to striking and during warm-up the current of the lamp must be limited to prevent internal lamp damage.

At times during warm-up, high intensity discharge lamps exhibit "bulb rectification". For reasons not completely clear, the lamp temporarily conducts in only one direction. Bulb rectification tends to decrease the useful life of the lamp unless the current to the lamp is quickly reduced. A ballast systems must achieve its objective while reducing the current during bulb rectification.

Certain prior art devices teach the use of current limiters and current detection circuits to control the current to the lamp. For example, U.S. Pat. No. 4,370,601 issued on Jan. 25, 1983 to Horii et al is one such device. U.S. Pat. No. 4,240,009 issued Dec. 6, 1980 to Paul teaches a control circuit for providing constant current to the lamp during warm-up and constant wattage thereafter. U.S. Pat. No. 4,238,710 issued Dec. 9, 1980 to Nelson teaches a voltage feedback control loop to minimize the effect of powerline variations. Similarly, in U.S. Pat. No. 4,415,839 issued Nov. 15, 1983 to Lesea the power consumption level of the lamp is monitored and lamp power consumption is regulated in response thereto.

However, none of the prior art devices recognizes the bulb rectification problem discussed above, and of course they do not suggest any means for solving it. Also, the prior art does not suggest current limiters which are capable of responding during the present duty cycle to further insure that a destructive overcurrent condition, such as that caused by bulb rectification, does not occur.

The Applicant's co-pending patent application Ser. No. 770,663 filed Aug. 28, 1985, and incorporated by reference herein, is an attempt to solve the problems of controlling lamp current during start-up and of bulb rectification. Ser. No. 770,663 uses a means sensitive to the radiant energy or heat of the lamp as a feedback loop to control the lamp's start-up characteristics.

SUMMARY OF THE INVENTION

A self-adjusting ballast system for a high intensity discharge lamp is taught, wherein current limiting means modify the present duty cycle to prevent damage to the lamp apparatus if bulb rectification or other overcurrent condition is present. The ballast system also has a current integration feedback loop to control the lamp current during start-up or when other overcurrent conditions are present.

It is a feature of the present invention to provide a self-adjusting ballast system which detects when the lamp is firing in one direction and not firing in the alternate half cycle, and in response thereto limits the current to the lamp during the same duty cycle to prevent damage to the lamp apparatus.

It is another feature of the present invention to provide a self-adjusting ballast system which detects current imbalances in the lamp, and controls the lamp current during start-up and otherwise, by use of a current integration feedback loop.

These and other features of the present invention will be apparent to one skilled in the art from the drawings and the detailed description.

BRIEF DESCRIPTION OF THE DRAWINGS

FIGS. 2A and 2B and FIG. 3 are circuit diagrams of the preferred embodiment of the present invention.

DETAILED DESCRIPTION

Figure 1:
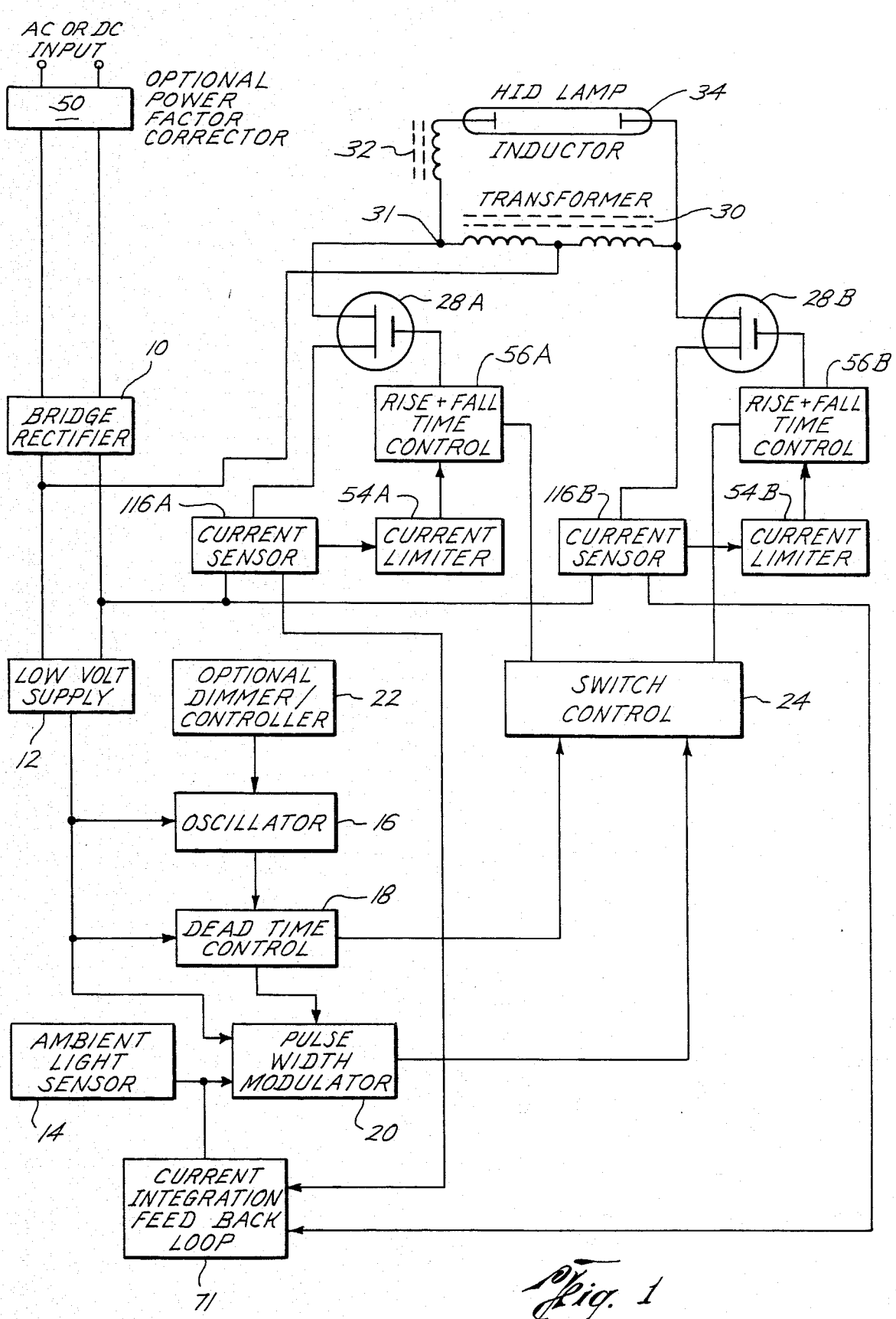
FIG. 1 is a block diagram illustrating the control sequences of a preferred embodiment of the present invention.

FIG. 1 illustrates in a schematic block diagram fashion the elements of a preferred embodiment of the self-adjusting ballast system utilizing a push-pull DC to AC converter, an autotransformer, a lamp circuit with two current limiters in series with the lamp, and a current integration feedback loop.

The scheme assumes an input of either alternating current or direct current. If the input is alternating current, AC to DC converter 10 rectifies in a traditional fashion the alternating wave into direct current waves. Optional power factor corrector 50 may be added to input alternating current lines for line power factor correction. Connecting the DC power line through converter 10 yields a safety feature. The lines of the ballast system cannot be connected incorrectly to a DC power source.

Low voltage supply 12, fed by input from converter 10, supplies low voltage direct current to an oscillator, a dead time controller and a pulse width modulator. The oscillator, dead time controller and pulse width modulator, together with the switch control, form the switch driving means.

Oscillator 16 generates a high frequency signal, high at least in relation to the line frequency. The period of each half cycle of oscillator 16 is set by resistor 114 and capacitor 115, according to the following formula:

$$\tfrac{1}{2}\text{ cycle period} = \frac{1}{\frac{1 \cdot 1}{RC}}$$

As an option, to vary the power outlet to the lamp, the frequency of oscillator 16 may be varied by dimmer 22. Dimmer 22, in addition to being a manually set dimming device, could be a lamp operation controller set by a photo sensitive device monitoring the lamp to run the lamp at constant intensity, set by a photo sensitive device monitoring illuminated areas to maintain constant illumination, or set by a lamp circuit voltage sensor which together with current limiters 54A and 54B could adjust the lamp for constant power consumption.

The frequency of oscillator 16 determines the frequency of the alternating current in the lamp circuit. The frequency of oscillator 16 and the voltage transformation performed by transformer 30 and tap 31 are chosen to permit the election of an efficient economical current limiting means, such as inductor 32, for the normal operating state for a given type of wattage of lamp.

The high frequency wave formed by oscillator 16 is supplied to dead time controller 18 and pulse width modulator 20. Pulse width modulator 20 is also supplied with input from ambient light sensor 14 and current integration feedback loop 71.

More particularly, the ambient light sensor circuit operates as follows to affect pulse width modulator 20. Referring to both FIG. 2 and FIG. 3, error amplifie5 13 amplifies the input of line 17 which contains the output of a voltage divider. Error amplifier 15 operates as a Schmitt trigger and performs the function of an on/off switch. Its output voltage is a function of the input from a voltage divider containing ambient light sensor 14. Error amplifier 15 either turns pulse width modulator comparator 20 to a continuous "off" state or does not effect the output of pulse width modulator comparator 20 at all.

Pulse width modulator comparator 20, when not turned to an "off" state by error amplifier 15, compares the input signal voltage from error amplifier 13 with the variable periodic signal voltage generated by oscillator 16. During that part of the oscillator signal cycle that the variable periodic signal voltage is greater than the signal voltage supplied by error amplifier 13, pulse width modulator comparator 20 is turned to an "on" state.

Referring now to FIG. 2, the operation of pulse width control subcircuit 40 will be discussed in greater detail. Subcircuit 40 includes the following:

1. Complete pulse width modulation control circuitry;
2. On chip oscillator 16;
3. Two user available operational amplifiers, error amps 15 and 13;
4. Internal 5 VDC reference (not shown);
5. Two output transistors 46 and 48 for driving the push-pull converter; and
6. Fixed or variable dead time controller 18.

A primary purpose of control subcircuit 40 is to develop two alternate pulse trains at a fixed frequency. In a preferred embodiment, the pulse width of each pulse being controlled varies from 0% to 48% with a minimum dead band (both pulses having a zero period) of 2%. Of course, dead bands of other lengths may be used.

Subcircuit 40 uses two operational amplifiers for pulse width modulation control, error amplifier 15 and feedback/pulse width modulator comparator 20.

Error amp 15 is used as a sky sensor in conjunction with a CDS-1 photocell or light sensor 14, resistors 100, 101, 102, 103, 104 and capacitor 105.

Resistors 100 and 102 are connected to the +5 VDC regulated supply, forming a voltage divider that is connected to the + input of amp 15.

Resistor 104 and light sensor 14 are connected to the 5 V regulated power supply and are connected to the—input of amp 15 by means of the RC Filter comprising resistor 103 and capacitor 105. With a bright sky, light sensor 14 has a low resistance value, causing the output of amp 15 to be +5 volts DC. This reduces the pulse width of alternate pulses to a zero period. The lamp 34 is then in the off condition. As the sky darkens, the resistance of light sensor 14 increases to a point where the amplifier voltage at the—input of amp 15 is more positive than the + input of amp 15 and the output of amp 15 goes to zero volts, initiating a full 48% duty cycle on the alternate drive pulses. Resistor 101 provides a hysteresis so that the turn on and turn off points are at slightly different levels. This results in a Schmitt trigger action.

Referring again to FIG. 1, dead time controller 18 produces a modulated output signal to correspond to a maximum duty cycle of slightly less than one hundred percent. Such dead time controller provides a safety period to insure that switch controller 24 cannot gate switches 28A and 28B on at the same time. As a result of dead time controller 18, switch control 24 must gate both switches 28A and 28B off for a minimum dead time each oscillating signal cycle.

Switch control 24 combines the outputs of dead time controller 18 and pulse width modulator 20 and sends the wave form alternately to gate on switch 28A or switch 28B. Rise and fall time controls 56A and 56B achieve a slow on/fast off of the gates of switches 28A and 28B to improve magnetic characteristics.

Current sensors 116A and 116B sense the current in switches 28A and 28B to determine if an overcurrent condition exists. If such an overcurrent condition is sensed, current limiters 54A and 54B in series with switches 28A and 28B, and in response to sensors 116A and 116B, automatically gate off each switch for that half cycle of the oscillator signal cycle when the switch current exceeds a certain safe value. The switch current may become excessive because of "bulb rectification" or exhibit imbalance because of lack of perfect magnetic symmetry in the transformer.

Switches 28A and 28B determine which primary of autotransformer 30 is being energized. An induced current of different voltage and of the same frequency is induced in the secondary of transformer 30 and thus in the circuit containing lamp 34 and current limiting inductor 32. The duty cycle for each half wave of the induced current in the lamp circuit is a function of the on and off times of switches 28A and 28B, which in turn is a function of the dead time controller 18 and pulse width modulator 20 of the switch driving means.

FIG. 2 and FIG. 3 represent a more specific circuit diagram for the preferred embodiment of the self-adjusting ballast system illustrated in FIG. 1. The embodiment illustrated in FIG. 3 utilizes a pulse width modulating subcircuit 40 that is commercially available. One suitable IC chip is a Motorola TL 494. Use of such circuit is convenient but not necessary.

In FIG. 2, it can be seen that AC to DC converter 10 consists of diode bridge rectifier 11. Snubber circuit 38 is provided to accommodate surges in voltage in the primary transformer circuit due to the rapidly alternating current.

Dead time controller 18 compares the variable periodic signal voltage from oscillator 16 each cycle with a minimal set control level voltage and is turned to an "on" state for all but a small percentage (e.g. 2%) of each signal cycle of oscillator 16. The logic of the pulse width modulator subcircuit 40 combines the output of dead time controller 18 with the output of pulse width modulator comparator 20 and permits NOR gates 42 and 44 to enable transistor switches 46 and 48 only when both controller 18 and comparator 20 are turned in the "on" state.

Dead time controller 18 generates the clock signal for flip flop 19, corresponding to the frequency of oscillator 16, so that output switch transistors 46 and 48 may be driven alternately through control of the flip flop by NOR gates 42 and 44. The output of the switch driver means are two pulse width modulated signals, at the frequency of oscillator 16, which open and close switches 28A and 28B.

Switches 21 and 23 serve to provide a slow on/fast off switching scheme for hexfets 28A and 28B. Switches 25 and 27 provide current sensing and control of the current passing through hexfet switches 28A and 28B.

Control subcircuit 40 has output transistors 46 and 48 (FIG. 3), the emitters of which drive the gates of hexfets 28A and 28B power switches of the push-pull DC to AC converter.

The operation of the push-pull converter will now be described in more detail.

The push-pull converter is made up of the following components:

- Power Hexfet Switches 28A and 28B
- Current sensing resistors 73 and 74
- Power transformer 30
- Clamp Diodes 76 and 77
- Clamp Resistor 78
- Clamp Capacitor 79
- Gate resistors 80 and 81
- Gate turn off transistors 21 and 23
- Gate Logic diodes 84 and 85
- Base turn off resistors 86 and 87 for transistors 21 and 23.

A positive drive pulse to the gate of hexfet 28A via output transistor 46, gate logic diode 84, and resistor 80, causes hexfet 28A to conduct, bringing the drain to near zero volts. This action impresses 160 volts across one half of transformer 30. Transformer action develops 320 volts at the drain of hexfet 28B. When the gate of hexfet 28A goes negative, transistor 21 conducts, discharging its internal gate capacitance in less than 200 N sec for rapid turn off time of hexfet 28A.

A positive drive pulse to the gate of hexfet 28B via transistor 48, gate logic diode 85, and resistor 81 causes hexfet 28B to conduct, bringing its drain to near zero volts. This action impresses 160 volts across its associated transformer winding. Transformer action in transformer 30 develops 320 volts at the drain of hexfet 28A. Then the gate of hexfet 28B goes negative and transistor 23 conducts discharging its interal gate capacitance in less than 200 N sec for rapid turn off of hexfet 28B.

It can been seen that the drain will alternate between 0 volts and +320 volts. When the drain of either hexfet exceeds the +160 volt power supply, either clamp diode 76 or 77 will conduct, charging capacitor 79 to +160 volts above the high voltage power supply. A voltage measurement from the cathode of clamp diodes 76 or 77 to common would indicate 320 volts. If the drain of either hexfet would attempt to spike above 320 volts, this voltage would be limited to approximately 320 volts protecting the hexfet from voltage damage.

Connected to the drains of hexfets 28A and 28B is a series load circuit consisting of power filter inductor 32 and mercury vapor lamp 34. On each half cycle, +320 volts is applied to the load circuit in one direction of the alternate half cycle, and +320 volts is applied to the load in the opposite direction. This puts a 320 V AC voltage across the load. Power inductor 32 limits the current to lamp 34. In the event the lamp impedance went to zero ohms, inductor 32 would limit the current to safe limits.

During the warm-up of lamp 34 (approximately 3 to 5 minutes), the lamp may exhibit "bulb rectification", that is, the characteristic of firing in one direction and not firing on the alternate half cycle. This action unbalances the transformer and causes it to go into saturation. The result is very high drain currents in hexfets 28A and 28B, and would eventually destroy them.

To protect hexfets 28A and 28B from destruction, a pair of current sensors 116A and 116B, and a pair of current limiters 54A and 54B are used (See FIG. 1). The current sensors will detect an overcurrent condition. The current limiters will remove gate drive from the overcurrent hexfet for a predetermined monostable period, nominally one half period of driving waveform.

The current limiter for hexfet 28A includes components diode 88, resistor 89, capacitor 90, resistors 91 and 92, and transistor 25.

The current limiter for hexfet 28B includes components diode 94, resistor 95, capacitor 96, resistors 97 and 98, and transistor 27.

The operation of hexfet 28A current limiter 54A is as follows.

When the voltage across current sensing resistor 73 exceeds 1.4 volts, capacitor 90 charges to a voltage above the $V_F$ of transistor 25, causing it to conduct. This removes gate drive from the hexfet 28A and stops the excessive current pulse. The rising of hexfet 28A drain to +320 volts helps transistor 25 to stay in conduction by current flow in resistor 92. Transistor 25 stays in conduction until capacitor 90 discharges below $V_F$ of transistor 25. Operation then returns to normal if no more high current pulses are present.

The current limiters are designed to respond within 500 N sec of an overcurrent condition and can respond during the pulse period of the driving waveform. The TL 494, when used as pulse width modulation subcircuit 40, could respond to an overcurrent condition but cannot cancel or reduce the pulse width of a pulse already in progress.

The overcurrent condition caused by unbalanced transformer action due to bulb rectification (firing in only one direction) can be corrected because the pulse width of the overcurrent condition is reduced while the next half cycle is of a full period attempting to balance the transformer.

As mentioned above, the present invention uses a current intergration feedback loop 71 (FIG. 1) to control the lamp characteristics during lamp warm-up or when other overcurrent conditions are present. Current feedback loop 71 will now be described in greater detail.

When the lamp is first struck or turned on, pulse width modulator 20 severely restricts current through the lamp circuit. Each switch is gated on only for a small fraction of each duty cycle. At the beginning of the warm-up cycle, the lamp's resistance is very low, and the lamp is very susceptible to damage if an overcurrent condition exists. As the lamp begins to warm-up, its resistance increases. The current integrator feedback loop compares the sensed current with a reference value, and communicates with the pulse width modulator. Assuming the sensed current is below the reference value, the pulse width modulator permits each switch to be gated on for a larger percentage of each duty cycle. Current is thereby gradually and precisely increased in correlation to a reference value yielding a precise control of current during warm-up. If the current is higher than the reference value, the duty cycle is reduced. This increases the lives of both the lamp apparatus and the ballast.

When the lamp is completely warmed-up, the circuit will operate in what constitutes its normal operating mode. Each switch then remains gated on for its maximum designed duty cycle, which in a preferred embodiment may be 48 percent of the time if a 2 percent dead time is used.

Figure 2A:
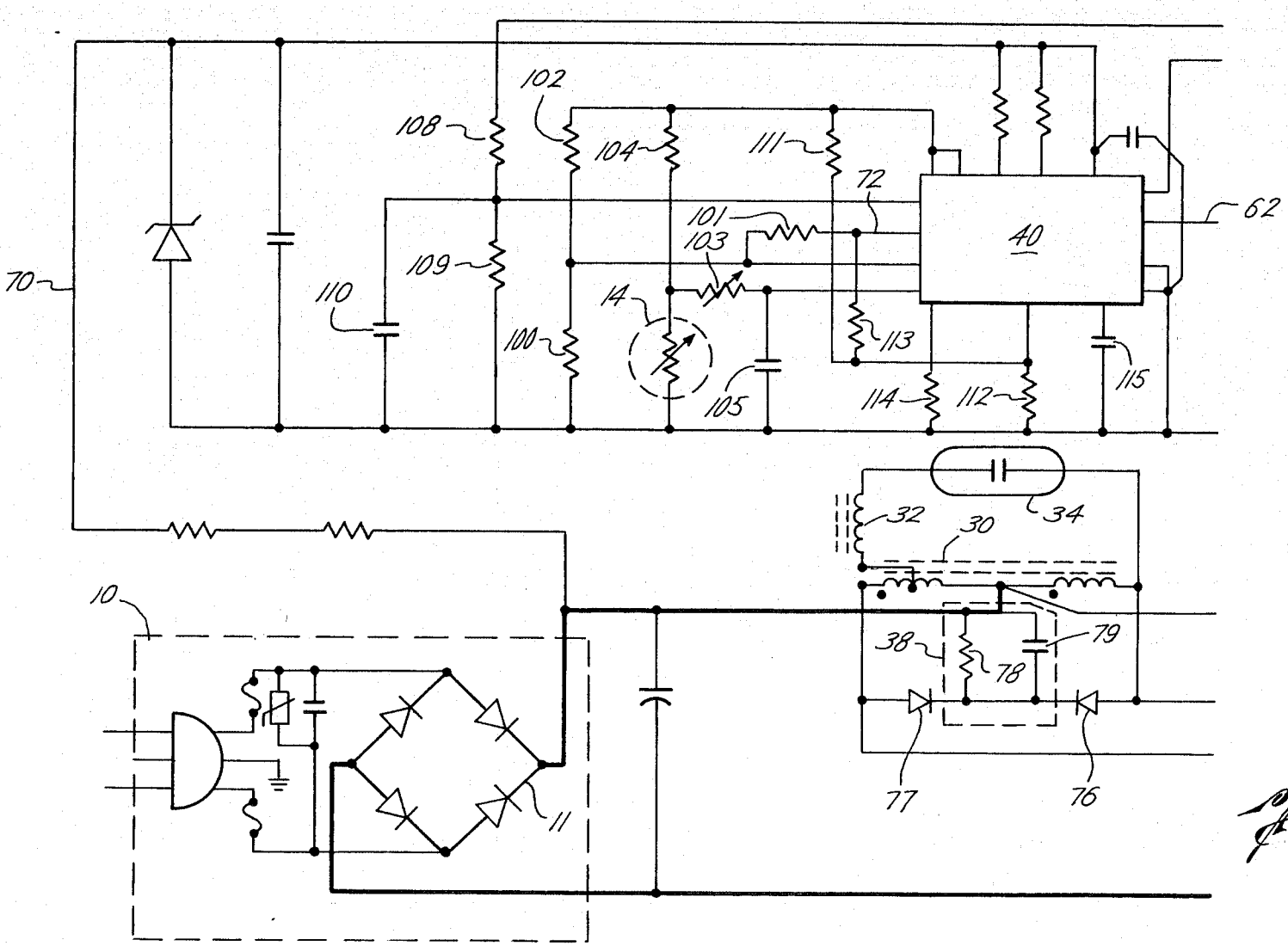

Referring to FIG. 3, error amplifier 13 is utilized for current integration feedback. When the light sensor 14 (FIG. 2A) detects dusk, the duty cycle goes to a full 48% each half cycle, and a great deal of current starts to flow in the lamp circuit. A voltage proportional to the current is developed across current sensing resistors 73 and 74 (FIG. 2B). Diodes 106 and 107 couple the voltage proportional to current to an intergrating network comprising resistors 108, 109, and capacitor 110. Capacitor 110 charges rapidly to a level proportional to the peak current in the lamp circuit. The voltage of capacitor 110 is input to the positive input of the error amplifier 13. Capacitor 110 rapidly charges and slowly discharges through resistor 109. Error amplifier 13 has a voltage divider comprising resistors 111 and 112 that establishes a reference voltage at the negative input of error amplifier 13. When the voltage of capacitor 110 exceeds the reference voltage, the output of error amplifier 13 goes positive at a gain of approximately 27 as set by the value of resistor 113. When the output of error amplifier 13 goes positive, the duty cycle of the pulse width modulator is reduced to a point where the high current in the lamp circuit is reduced to a level below the reference level. Capacitor 110 slowly discharges, increasing the duty cycle towards its maximum, e.g. 48%. If the overcurrent condition is encountered again, the procedure repeats itself again. During this time the bulb is heating and reaches a point of stabilization when the high current is not encountered. The bulb fully warms up to a 48% duty cycle on each half cycle. Current integrator 71 is normally only active during bulb warm-up but will respond within 50 microseconds to any overcurrent condition encountered.

What is claimed is:

1. A self-adjusting ballast system for mercury vapor, high intensity discharge lamps having outputs of 100 watts or greater, comprising:

a direct current source;

a lamp circuit containing a lamp;

a high frequency oscillator;

a current feedback means for sensing the current present in said lamp, comparing said current with a reference value, and outputting an output signal;

a pulse width modulator responsive to said output signal of said current feedback means;

a DC to AC converter that by control of at least one switch converts current of one voltage from said direct current source to alternating current of a different or the same voltage, said converter including a switch driving means for driving the at least one switch, said converter being responsive to said high frequency oscillator and to said pulse width modulator; and means for sensing the current being supplied to said lamp and for quickly limiting the current to a predetermined safe level if too much current is being supplied to said lamp.

2. A self-adjusting ballast system for mercury vapor, high intensity discharge lamps having outputs of 100 watts or greater, comprising:

a direct current source;

a lamp circuit containing a lamp;

a high frequency oscillator;

a current feedback means for sensing the current present in said lamp, comparing said current with a reference value, and outputting an output signal;

a pulse width modulator responsive to said output signal of said current feedback means;

a DC to AC converter that by control of at least one switch converts current of one voltage from said direct current source to alternating current of a different or the same voltage, said converter including a switch driving means for driving the at least one switch, said converter being responsive to said high frequency oscillator and to said pulse width modulator; and means for detecting that the current across said lamp is travelling in only a single direction and for limiting the current to said lamp to a predetermined safe level if too much current is being supplied to said lamp.

3. The apparatus of claim 1 or 2 wherein the direct current source comprises:

an alternating current source of approximately 110 volts; and a full wave bridge rectifier.

4. The apparatus of claim 1 or 2, further comprising:

sensing means for sensing the ambient light surrounding the lamp and for affecting the operation of said DC to AC converter by causing said converter to supply current to said lamp circuit only when the ambient light surrounding the lamp is below a preset level.

5. The apparatus of claim 1 or 2 wherein:

said current limiter limits current to said lamp by removing gate drive from said switch for a predetermined period of time.

6. The apparatus of claim 1 or 2, further comprising:

a dead time controller for controlling said at least one switch so that said switch is gated off for a predetermined period of time.

* * * * *